US008528567B2

(12) United States Patent
Hajaligol

(10) Patent No.: US 8,528,567 B2
(45) Date of Patent: Sep. 10, 2013

(54) SMOKING ARTICLE HAVING EXOTHERMAL CATALYST DOWNSTREAM OF FUEL ELEMENT

(75) Inventor: Mohammad R. Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 831 days.

(21) Appl. No.: 12/579,589

(22) Filed: Oct. 15, 2009

(65) Prior Publication Data

US 2011/0088707 A1 Apr. 21, 2011

(51) Int. Cl.
*A24F 1/32* (2006.01)

(52) U.S. Cl.
USPC ..... 131/194; 131/334

(58) Field of Classification Search
USPC ..... 131/194, 334
See application file for complete search history.

(56) References Cited

U.S. PATENT DOCUMENTS

| | | | |
|---|---|---|---|
| 4,714,082 | A | 12/1987 | Banerjee et al. |
| 4,732,168 | A | 3/1988 | Resce et al. |
| 4,756,318 | A | 7/1988 | Clearman et al. |
| 4,981,522 | A | 1/1991 | Nichols et al. |
| 4,991,606 | A | 2/1991 | Serrano et al. |
| 5,040,552 | A | 8/1991 | Schleich et al. |
| 5,076,296 | A | 12/1991 | Nystrom et al. |
| 5,146,934 | A | 9/1992 | Deevi et al. |
| 5,211,684 | A | 5/1993 | Shannon et al. |
| 5,240,014 | A | 8/1993 | Deevi et al. |
| 5,246,018 | A | 9/1993 | Deevi et al. |
| 5,247,949 | A | 9/1993 | Deevi et al. |
| 5,322,075 | A | 6/1994 | Deevi et al. |
| 5,345,951 | A | 9/1994 | Serrano et al. |
| 5,443,560 | A | 8/1995 | Deevi et al. |
| 5,546,965 | A | 8/1996 | White |
| 5,595,577 | A | 1/1997 | Bensalem et al. |
| 5,944,025 | A | 8/1999 | Cook et al. |
| 5,996,589 | A | 12/1999 | St. Charles |
| 6,164,287 | A | 12/2000 | White |
| 6,598,607 | B2 | 7/2003 | Adiga et al. |
| 6,857,431 | B2 | 2/2005 | Deevi et al. |
| 2005/0121044 | A1 | 6/2005 | Banerjee et al. |

FOREIGN PATENT DOCUMENTS

| | | | |
|---|---|---|---|
| EP | 0481192 | A1 | 4/1992 |
| EP | 0535695 | A2 | 4/1993 |

OTHER PUBLICATIONS

International Search Report and Written Opinion mailed Feb. 24, 2011 for PCT/EP2010/006299.
International Preliminary Report on Patentability issued Apr. 17, 2012 for PCT/EP2010/006299.

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smoking article having a heat source at a first end of the smoking article and a catalyst adjacent to the heat source. The catalyst is capable of catalyzing carbon monoxide from the heat source to carbon dioxide and water. A filter segment is located at a second end of the smoking article opposite the first end with an aerosol generating segment disposed between the catalyst and the filter segment.

22 Claims, 3 Drawing Sheets

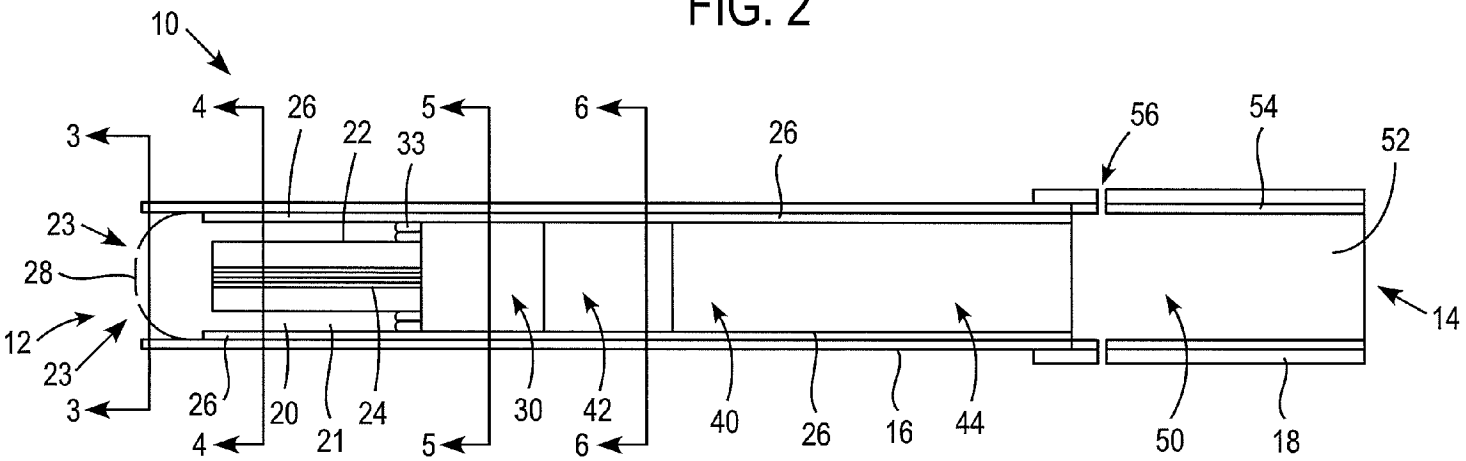
FIG. 2
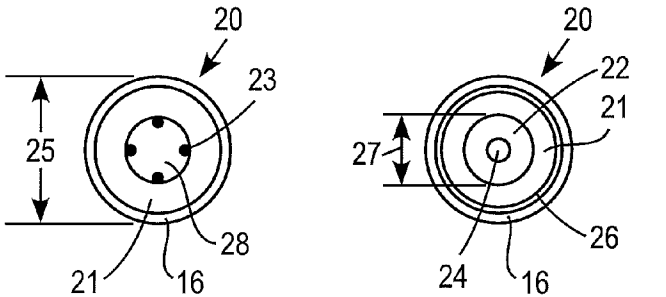
FIG. 3
FIG. 4
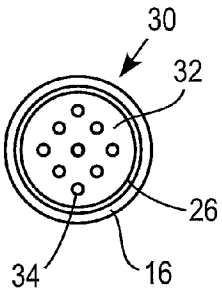
FIG. 5
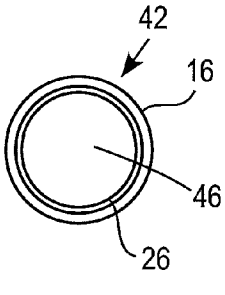
FIG. 6
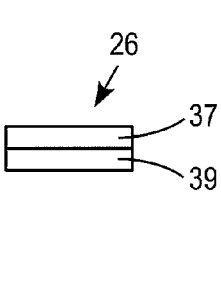
FIG. 7

SMOKING ARTICLE HAVING EXOTHERMAL CATALYST DOWNSTREAM OF FUEL ELEMENT

WORKING ENVIRONMENT

Traditional cigarettes deliver flavor and aroma to the smoker as a result of combustion, during which a mass of tobacco is combusted at temperatures which often exceeds 800 degrees Celsius during a puff. The heat of combustion releases various gaseous combustion products and distillates from the tobacco. As these gaseous products are drawn through the cigarette, they cool and condense to form an aerosol which provides the tastes and aromas associated with smoking.

Traditional cigarettes produce sidestream smoke during smoldering between puffs. Once lit, they must be fully consumed or be discarded. Re-lighting a traditional cigarette is possible but is usually an unattractive proposition to a discerning smoker for subjective reasons (flavor, taste, odor).

An alternative to the more traditional cigarettes includes those in which the combustible material itself does not itself release the tobacco aerosol. Such smoking articles may comprise a combustible, carbonaceous heating element (heat source) located at or about one end of the smoking article and a bed of tobacco-laden elements located adjacent the aforementioned heating element. The heating element is ignited with a match or cigarette lighter, and when a smoker draws upon the cigarette, heat generated by the heating element is communicated to the bed of tobacco-laden elements so as to cause the bed to release a tobacco aerosol. While this type of smoking device produces little or no sidestream smoke, it still generates products of combustion at the heat source, and once its heat source is ignited, it is not readily snuffed for future use in a practical sense.

Accordingly, it would be desirable to have a smoking article with a low sidestream smoke, which produces an acceptable aerosol and reduces the smoker's exposure to products of combustion from the heating element or heat source.

SUMMARY

In accordance with one embodiment, a smoking article comprises: a heat source at a first end of the smoking article; a catalyst adjacent to the heat source, the catalyst capable of catalyzing carbon monoxide from the heat source to carbon dioxide; a filter segment at a second end of the smoking article opposite the first end; and an aerosol generating segment disposed between the catalyst and the filter segment.

In accordance with a further embodiment, a smoking article comprises: a heat source at a first end of the smoking article; a catalyst adjacent to the heat source, the catalyst being capable of catalyzing products of combustion from the heat source to a benign substance; a filter segment at a second end of the smoking article opposite the first end; and an aerosol generating segment disposed between the catalyst and the filter segment.

BRIEF DESCRIPTION OF THE DRAWINGS

FIG. 2 shows a longitudinal cross-sectional view of the smoking article of FIG. 1.

FIG. 3 shows a cross-sectional view of the smoking article of FIG. 2 along the line 3-3.

FIG. 4 shows a cross-sectional view of the smoking article of FIG. 2 along the line 4-4.

FIG. 5 shows a cross-sectional view of the smoking article of FIG. 2 along the line 5-5.

FIG. 6 shows a cross-sectional view of the smoking article of FIG. 2 along the line 6-6.

FIG. 7 shows a cross-sectional view of a reflective liner.

DETAILED DESCRIPTION

Figure 1:
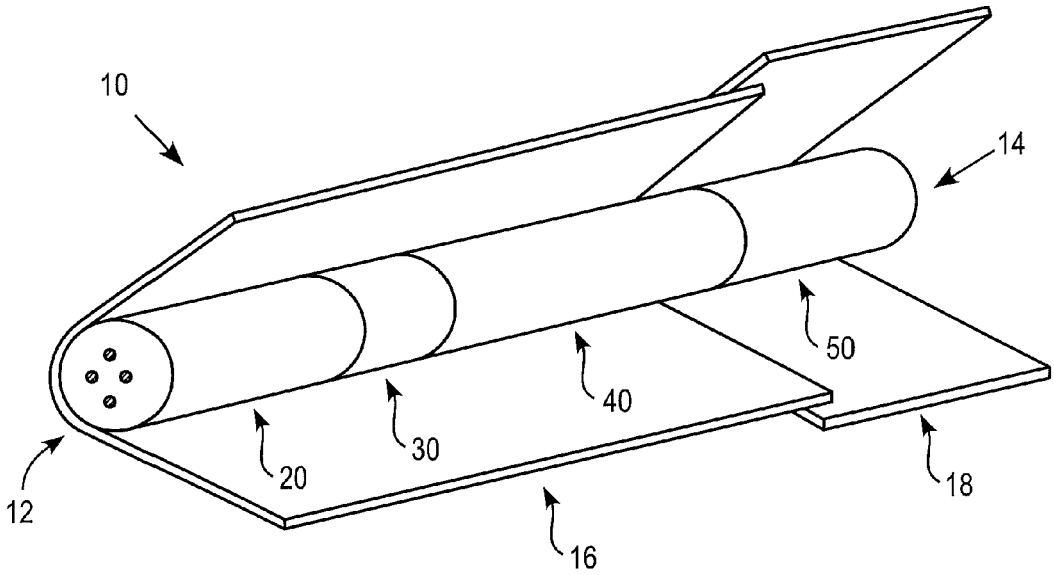
FIG. 1 shows an exploded view of a smoking article incorporating a catalyst downstream of the heat source.

FIG. 1 shows an exploded view of a smoking article 10 incorporating a catalyst or catalyst segment 30 adjacent to a fuel element or heat source 20. In use, the catalyst 30 reduces the smoker's exposure to products of combustion from the heat source 20 by converting the products of combustion into a benign substance, such as carbon dioxide and water. As shown in FIG. 1, the smoking article 10 includes a heat source 20, a catalyst segment 30 adjacent to the heat source 20, a filter segment 50 and an aerosol generating segment 40 between the catalyst segment 30 and the filter segment 50. The heat source 20 is located at a first end 12 of the smoking article 10 with the catalyst segment 30 downstream of the heat source 20. The filter segment 50 is located at a second end 14 of the smoking article 10 opposite the first end 12 with the aerosol generating segment 40 disposed between the catalyst segment 30 and the filter segment 50. Herein, the "upstream" and "downstream" relative positions between segments and other features are described in relation to the direction of the products of combustion and aerosols as they are generated and/or formed and drawn from the heat source 20 through the catalyst segment 30, the aerosol generating segment 40, and the filter segment 50.

As shown in FIG. 1, the heat source 20, the catalyst segment 30, and the aerosol generating segment 40 are surrounded or wrapped with a wrapping paper 16. The wrapping paper 16 preferably will have sufficient porosity to allow air to be admitted through the paper 16 to support combustion within the heat source 20. Alternatively, the wrapping paper 16 can be perforated 58 (FIG. 8), such as by laser perforation, in the region which surrounds the heat source 20 to allow air into the heat source 20.

In addition, a reflective liner 26 (FIG. 2) can be used to reflect heat from a heat source material 22 back into the heat source 20 to keep it hot and thus ensure that the heat source 20 does not cool below its ignition temperature and become extinguished. Alternatively, the wrapping paper 16 can be treated with a material such as magnesium oxide or other suitable refractory type, cigarette paper to minimize thermal degradation. The filter segment 50 is preferably attached to the heat source 20, the catalyst segment 30 and the aerosol generating segment 40 by a tipping paper 18.

In use, the smoking article 10 produces an aerosol, which is generated by heat transfer to an aerosol generating material 42 within the aerosol generating segment 40. In one embodiment, the catalyst segment 30 converts carbon monoxide produced by the heat source 20 to carbon dioxide (and water). In addition, the catalyst segment 30 can produce additional heat, which in combination with the heat generated from combustion within the heat source 20 is transferred to the aerosol generating material 42. The aerosol generating material 42 releases flavored (or medicant) vapors and gases when contacted by heat (typically, in the form of a heated or hot gas) generated by the heat source 20 and catalyst segment 30. The vapors then pass into an optional aerosol chamber 44, forming an aerosol which passes through the filter segment 50 and into the mouth of the smoker.

FIG. 2 shows a longitudinal cross-sectional view of the smoking article 10 of FIG. 1, which includes the heat source 20, the catalyst segment 30, the aerosol generating segment 40 and the filter segment 50. The heat source 20 includes a heat source material 22, which generates a heated gas upon combustion. The heat source material 22 can be a carbonaceous material as described in commonly owned U.S. Pat. No. 5,076,296, which is incorporated herein in its entirety, an extracted tobacco filler with an activated carbon or other suitable materials that generate a heated gas. Typically, the heat source material 22 will produce a product of combustion in the form of carbon monoxide, however, it can be appreciated that the heat source 20 can include a heat source material 22 that produces little or no carbon monoxide.

In one embodiment, the heat source material 22 can be a carbonaceous material, such as a carbonized material such as pure carbon. Alternatively, the heat source material 22 can a non-carbonized material carbonaceous material, which is not made by carbonizing a carbon source, a charcoal, or other suitable heat generating material. The heat source material 22 also preferably includes an gas or air flow passage in the form of one or more longitudinal passageways 24 extending therethrough for gas or air flow through the heat source material 22 to the catalyst 30.

The catalyst segment 30 is preferably adjacent to the heat source 20 and is comprised of a catalyst material 32 (FIG. 5), which is capable of catalyzing carbon monoxide to carbon dioxide and water. The catalyst material 32 preferably has a low light-off temperature, and is highly reactive to convert the combustion products to carbon dioxide (and water). It can be appreciated that any suitable catalyst material 32, which is capable of converting combustion products from the heat source 20 to a benign product, such as carbon dioxide can be used. For example, the catalyst material 32 can be a mixed metal oxide, a copper oxide and ceria, or at least one transition metal, such as magnesium oxide (MgO), ferrous oxide (FeO), or zinc oxide (ZnO).

The aerosol generating segment 40 includes an aerosol generating material 42, which when heated, generates or releases an aerosol, which can be drawn in by the smoker. The aerosol generating material 42 is preferably a tobacco-flavored unit in the form of a conventional or hollow cigarette, tobacco pellets, loose shreds or other suitable materials. However, the aerosol generating material 42 can include tobacco condensates or fractions thereof (condensed components of the smoke produced by the combustion of tobacco, leaving flavors and, possibly, nicotine), or tobacco extracts or fractions thereof, deposited on an inert substrate.

The aerosol generating material 42 can also include an aerosol-forming material, such as glycerine or water, so that the smoker has the perception of inhaling and exhaling "smoke" as in a conventional cigarette. A particularly preferred material is a composition such as that described in commonly-assigned U.S. Pat. No. 4,981,522, hereby incorporated by reference in its entirety, which describes pelletized tobacco containing glycerine (as an aerosol-forming ingredient) and calcium carbonate (as a filler).

In another embodiment, the aerosol generating material 42 can be a reconstituted tobacco product having a burn inhibitor additive to prevent oxidation. It can be appreciated that the aerosol generating material 42 can also include pharmaceutical compositions, medicants, or other flavorants for the delivery of functional ingredients or additives.

As shown in FIG. 2, the aerosol generating segment 40 can also include an optional aerosol chamber 44, which is downstream of the aerosol generating material 42. The aerosol chamber 44 provides length to the smoking article 10 and thus the appearance of a cigarette. In addition, the aerosol chamber 44 provides the smoking article 10 with a chamber or an enclosure for the generation and/or growth of the aerosols from the aerosol generating material 42. In use, the optional aerosol chamber 44 also improves the overall visibility of the aerosol to the smoker. The aerosol generating chamber 44 preferably has a length of about 15 to 35 mm, so that the smoking article 10 has an overall length of about 70 to 85 mm, which is comparable to a conventional "long-size" cigarette.

Figure 9:
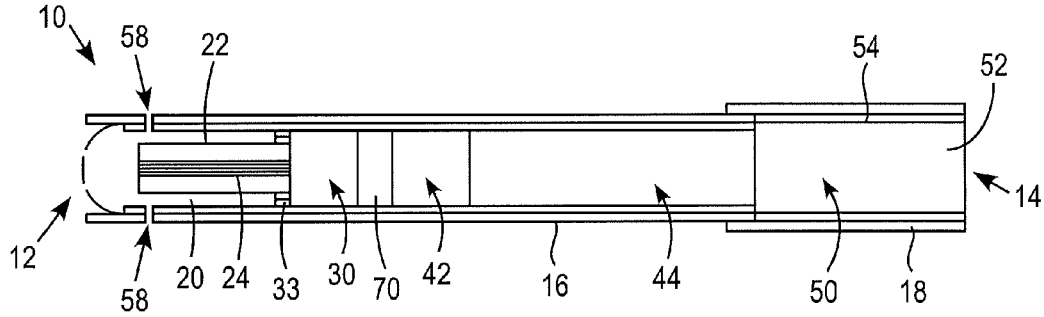
FIG. 9 shows a longitudinal cross-sectional view of a further embodiment of a smoking article incorporating a catalyst downstream of the heat source.

In an alternative embodiment, the aerosol generating segment 40 comprises only an aerosol generating material 42 without an aerosol chamber (FIG. 9). Typically, if the smoking article 10 does not include an aerosol chamber 44, the aerosols generated by the aerosol generating material 42 may not be as visible to the smoker as with an aerosol forming chamber 44. Accordingly, it can be appreciated that an additive within the aerosol generating material 44, such as glycerine or water can be added to the aerosol generating material 42 to improve the visibility of the aerosols.

The filter segment 50 includes a filter material 52, which can be a starch-based, polypropylene, or plasticized cellulose acetate tow, circumscribed by a plug wrap 54. The filter material 52 also can have the form of a gathered web (e.g., polypropylene web, polyester web or starch-based web). If desired, the filter material 52 can have at least one cavity, sleeve, sorbent, passage or groove (not shown) extending longitudinally therethrough or partially therethrough. The plug wrap 54 is a paper which optionally incorporates a carbonaceous material. The plug wrap 54 circumscribes the total length of the filter segment 50.

The filter segment 50 is attached to the heat source 20, catalyst segment 30 and aerosol generating segment 40 by the tipping material 18, which circumscribes both the entire length of the filter segment 50 and an adjacent region of the aerosol generating segment 40. The tipping material 18 is typically a paper like product; however, any suitable material can be used. The inner surface of the tipping material 18 is fixedly secured to the outer surface of the plug wrap 54 and the outer surface of the wrapping material 16 of the aerosol generating segment 40, using a suitable adhesive. The filter segment 50 preferably has a length of about 15 to 25 mm. As shown in FIG. 2, the smoking article 10 can include added ventilation or air dilution with a series of ventilation holes or perforations 56 in the filter segment 50, each of which extend through the tipping material 18 and the plug wrap 54.

FIG. 3 is a cross-sectional view of the smoking article of FIG. 2 along the line 3-3 at the first end 12 of the smoking article 10. As shown in FIG. 3, the first end 12 of the smoking article 10 is preferably provided with a reflective end cap 28, which attaches to the reflective liner 26 and is covered with the wrapping paper 16. The cap 28 preferably has at least one or more openings 23 which allow air into the heat source 20. In use, the cap 28 increases the reflection of the heat or hot gases from the heat source material 22 towards the downstream segments, including the catalyst 30 and aerosol generating material 22. The cap 28 also prevents the heat source material 22 from falling out of the smoking article 10 if it somehow becomes loose. In addition, the cap 28 retains any ash within the smoking article 10 that may form during burning of heat source material 22.

As shown in FIG. 3, the smoking article 10 preferably has an outer diameter 25 of about 7.9 mm, which is similar to a conventional lit end cigarette. The heat source material 22 preferably has a diameter 27 of about 4.0 mm to 5.0 mm with an annular space 21 extending from an inner surface of the reflective sleeve to the outer surface of the heat source material 22.

FIG. 4 is a cross-sectional view of the smoking article of FIG. 2 along the line 4-4. As shown in FIG. 4, the heat source 20 comprises the heat source material 22 having one or more longitudinal passageways 24 extending therethrough, an annular space 21, and a reflective liner 26, which is surrounded by the wrapping paper 16. The reflective liner 26 is also designed to minimize heat loss through the wrapping paper 16.

As shown in FIG. 4, the heat source 20 is preferably cylindrical in shape, and fits inside the first end 12 of the smoking article 10. The heat source 20 includes a heat source material 22, which can generate enough heat to ensure that the gases flowing therethrough are heated sufficiently to release enough tobacco flavor or other flavorants from the aerosol generating material 42. For example, if the aerosol generating material 44 is a tobacco product, the heat source material 22 should be able to sufficiently heat the aerosol generating material 44 to release enough tobacco flavor to provide conventional cigarette flavor to the smoker.

FIG. 5 is a cross-sectional view of the smoking article of FIG. 2 along the line 5-5. As shown in FIG. 5, the catalyst segment 30 comprises a catalyst material 32, which is capable of catalyzing carbon monoxide produced by combustion from the heat source 20 to carbon dioxide and water. The catalyst material 32 preferably has a low light-off temperature and high reactivity to convert the combustion products from the heat source 20 to a benign material, such as carbon dioxide. It can be appreciated that any suitable catalyst material 32, which is capable of converting combustion products from the heat source 20 to a benign or suitable product, such as carbon dioxide (and water) can be used.

The catalyst material 32 is preferably a porous material 34, such that mainstream smoke can pass through the catalyst material 32. It can be appreciated that the catalyst material 32 can be in the form of a porous disk or cylinder as shown in FIG. 2 having an approximate thickness or length of about 4 to 5 mm.

It can be appreciated that the catalyst material 32, will preferably be capable of converting carbon monoxide produced by the combustion from the heat source 20 to carbon dioxide and water can be used. For example, the catalyst material 32 can be a mixed metal oxide, a copper oxide and ceria, and at least one transition metal, such as magnesium oxide (MgO), ferrous oxide (FeO), or zinc oxide (ZnO). In an alternative embodiment, the catalyst material 32 can be provided on a support (not shown) of ceria, zirconia, titania, alumina, and/or mixtures thereof or other suitable materials. It can be appreciated that the catalyst material 32 is not limited to the above-mentioned examples, and any suitable catalyst material 32, which is capable of converting combustion products from the heat source 20 to a benign or suitable product, such as carbon dioxide (and water) can be used. In addition, the catalyst material 32 may provide an addition source of heat to the aerosol generating segment 40.

FIG. 6 is a cross-sectional view of the smoking article of FIG. 2 along the line 6-6. As shown in FIG. 6, the aerosol generating segment 40 comprises a plug or capsule 46 of aerosol generating material 42 and an optional aerosol generating chamber 44 (FIG. 2). The aerosol generating material 42 is preferably a tobacco-flavored unit in the form of a conventional or hollow cigarette, tobacco pellets, loose shreds or other suitable materials. However, the aerosol generating material 42 can include tobacco condensates or fractions thereof (condensed components of the smoke produced by the combustion of tobacco, leaving flavors and, possibly, nicotine), or tobacco extracts or fractions thereof, deposited on an inert substrate. Alternatively, the aerosol generating material 42 can be a plug 46 of shredded reconstituted tobacco leaf having a burn inhibitor such as phosphate salt or other suitable inhibitor to prevent oxidation.

As shown in FIGS. 2-6, the heat source 20, the catalyst segment 30 and aerosol generating material 42 are preferably housed in a reflective liner 26. The reflective liner 26 as shown in FIG. 7 is preferably comprised of an outer paper layer 37 and an inner foil layer 39. The foil layer 39 reflects heat radiated from the heat source material 22 back into the heat source material 22 to keep it hot and thus ensure that the heat source material 22 does not cool below its ignition temperature and become extinguished. In addition, the reflective liner 26 minimizes heat loss through the wrapping paper 26. The inner foil layer 39 can be made from a metallized paper, such as aluminum or other suitable material, which reflects heat radiated from the heat source 20.

The heat source 20 can also include an inner support 33, which can be folded to secure the heat source material 22 within the heat source 20 and adjacent to the catalyst segment 30. The inner support 33 also suspends the heat source material 22 away from an interior wall of the reflective liner 26, leaving an annular space 21.

Figure 8:
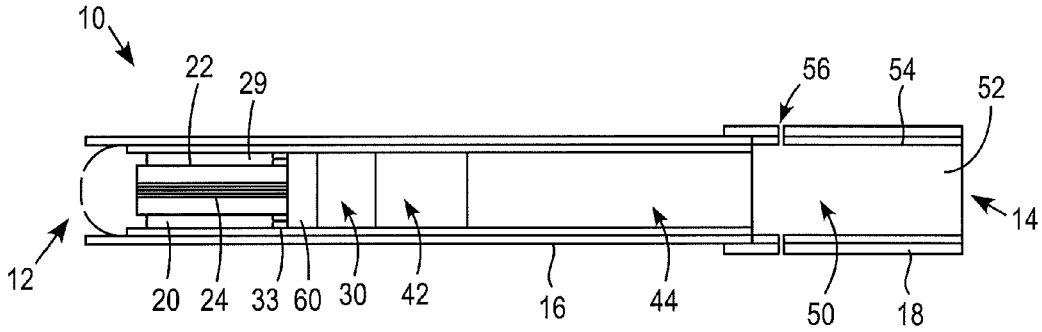
FIG. 8 shows a longitudinal cross-sectional view of another embodiment of a smoking article incorporating a catalyst downstream of the heat source.

FIG. 8 shows a longitudinal cross-sectional view of another embodiment of a smoking article 10 incorporating a catalyst 30 downstream of the heat source 20 to convert carbon monoxide produced by the heat source 20 into carbon dioxide and water. As shown in FIG. 8, the heat source material 22 can also be surrounded by a tobacco product 29 to provide aroma to the smoking article 10. The tobacco product 29 is preferably treated with an inhibitor such as phosphoric acid ($H_3PO_4$), or other suitable materials so that the tobacco does not ignite nor burn. The tobacco product 29 also occupies a portion of the annular space 21 around the downstream portion of the heat source material 22 preventing the heat source material 22 from becoming loose.

In addition, as shown in FIG. 8, the smoking article 10 can include an air mixing space or segment 60 between the heat source 20 and the catalyst segment 30. The air mixing space or segment 60 is preferably at least 2 mm in length and more preferably 3 to 7 mm in length and most preferably about 5 mm in length. The air mixing space or segment 60 increases the utilization of catalyst material 32 within the catalyst segment 30. The air mixing space or segment 60 can also increase the extraction of flavor or aerosols from the aerosol generating material 42 by increasing the heat flow to the aerosol generating material 42.

FIG. 9 shows a longitudinal cross-sectional view of a further embodiment of a smoking article 10 incorporating heat source 20 having an adjacent catalyst segment 30, which is capable of converting product combustion from the heat source 20 into carbon dioxide (and water), a benign substance, or other suitable products. As shown in FIG. 8, the smoking article 10 can include an air mixing space or segment 70 between the catalyst segment 30 and the aerosol generating material 42. The air mixing space or segment 70 is preferably at least 2 mm in length and more preferably 3 to 7 mm in length and most preferably about 5 mm in length. The air mixing space or segment 70 increases the extraction of flavor or aerosols from the aerosol generating material 42 with an increase heat flow.

Figure 10:
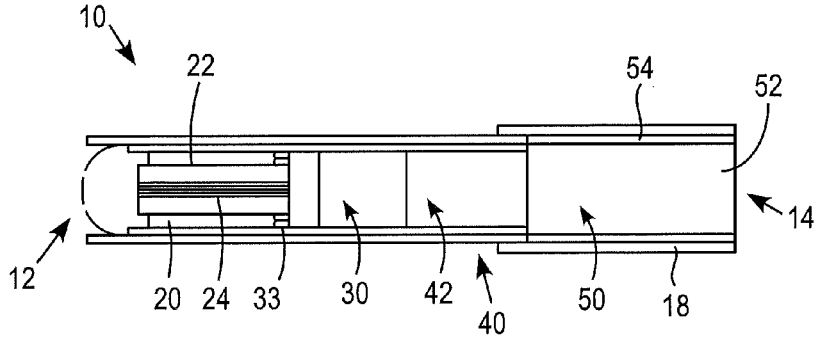
FIG. 10 shows a longitudinal cross-sectional view of another embodiment of a smoking article incorporating a catalyst downstream of the heat source.

FIG. 10 shows a longitudinal cross-sectional view of another embodiment of a smoking article 10 incorporating a catalyst 30 downstream of the heat source 20 to convert carbon monoxide produced by the heat source 20 into carbon dioxide and water. As shown in FIG. 10, the smoking article 10 includes a heat source 20, a catalyst 30, an aerosol generating material 42 and a filter segment 50. The aerosol generating material 42 as shown in FIG. 10, is adjacent to the filter segment 50 and does not include an aerosol generating chamber 44.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:
- a heat source at a first end of the smoking article;
- a catalyst adjacent to the heat source, the catalyst capable of catalyzing carbon monoxide from the heat source to carbon dioxide;
- a filter segment at a second end of the smoking article opposite the first end;
- an aerosol generating segment disposed between the catalyst and the filter segment; and
- an air mixing segment disposed between the heat source and the catalyst.

2. The smoking article of claim 1, wherein the aerosol generating segment comprises an aerosol generating material and an aerosol chamber.

3. The smoking article of claim 2, wherein the aerosol generating material is a tobacco product.

4. The smoking article of claim 1, wherein the catalyst is comprised of a porous material, which the porous material allows a combustion product from the heat source to pass through the catalyst.

5. The smoking article of claim 1, wherein the catalyst is a porous cylinder.

6. The smoking article of claim 1, wherein the catalyst comprises a mixed metal oxide.

7. The smoking article of claim 1, wherein the catalyst is comprised of copper oxide and ceria.

8. The smoking article of claim 1, wherein the catalyst includes at least one transition metal.

9. The smoking article of claim 8, wherein the at least one transition metal is selected from the following: magnesium oxide (MgO), ferrous oxide (FeO) or zinc oxide (ZnO).

10. The smoking article of claim 1, wherein the heat source comprises a carbonaceous heat source material.

11. The smoking article of claim 10, wherein the carbonaceous heat source material is a carbonized material.

12. The smoking article of claim 10, wherein the heat source material includes an air flow passage extending therethrough.

13. The smoking article of claim 10, wherein the heat source material is surrounded by tobacco material to provide the smoking article with a tobacco aroma.

14. The smoking article of claim 1, wherein the heat source further includes a reflective liner on an inner surface of a wrapping paper.

15. The smoking article of claim 14, wherein the reflective liner extends from the heat source to the aerosol generating segment.

16. A smoking article comprising:
- a heat source at a first end of the smoking article;
- a catalyst adjacent to the heat source, the catalyst capable of catalyzing carbon monoxide from the heat source to carbon dioxide;
- a filter segment at a second end of the smoking article opposite the first end;
- an aerosol generating segment disposed between the catalyst and the filter segment; and
- an air mixing segment disposed between the catalyst and the aerosol generating segment.

17. The smoking article of claim 16, wherein the aerosol generating segment comprises an aerosol generating material and an aerosol chamber.

18. A smoking article comprising:
- a heat source at a first end of the smoking article;
- a catalyst adjacent to the heat source, the catalyst being capable of catalyzing products of combustion from the heat source to a benign substance;
- a filter segment at a second end of the smoking article opposite the first end;
- an aerosol generating segment disposed between the catalyst and the filter segment; and
- an air mixing segment disposed between the heat source and the catalyst.

19. The smoking article of claim 18, wherein the aerosol generating segment comprises an aerosol generating material and an aerosol forming chamber.

20. The smoking article of claim 19, wherein the aerosol generating material is a tobacco product.

21. A smoking article comprising:
- a heat source at a first end of the smoking article;
- a catalyst adjacent to the heat source, the catalyst being capable of catalyzing products of combustion from the heat source to a benign substance;
- a filter segment at a second end of the smoking article opposite the first end;
- an aerosol generating segment disposed between the catalyst and the filter segment, and
- an air mixing segment disposed between the catalyst segment and the aerosol generating segment.

22. The smoking article of claim 21, wherein the aerosol generating segment comprises an aerosol generating material and an aerosol forming chamber.

* * * * *